United States Patent [19]

Shiryon

[11] Patent Number: 4,984,807

[45] Date of Patent: Jan. 15, 1991

[54] BOARD GAME

[76] Inventor: Baruch Shiryon, Anderson St. 2, Tel Aviv, Israel

[21] Appl. No.: 463,728

[22] Filed: Jan. 12, 1990

[51] Int. Cl.[5] ..... A63F 3/02; A63F 3/00

[52] U.S. Cl. ..... 273/262; 273/282 LM; 273/284; 273/283

[58] Field of Search ..... 273/284, 283, 282 C, 273/290, 260, 262

[56] References Cited

U.S. PATENT DOCUMENTS

| | | | |
|---|---|---|---|
| 3,186,716 | 6/1965 | Shabarick | 273/290 |
| 3,820,791 | 6/1974 | Powers | 273/284 |
| 4,211,420 | 7/1980 | Quiroz | 273/260 |
| 4,512,584 | 4/1985 | Propsom | 273/282 C |
| 4,753,441 | 6/1988 | Braus | 273/284 |

*Primary Examiner*—Benjamin Layno
*Attorney, Agent, or Firm*—Benjamin J. Barish

[57] ABSTRACT

A board game playable by two players comprises a board divided into a plurality of equally sized square areas, a number of removable square tiles sufficient to fill all the squares of the board, a plurality of playing pieces for each player movable over the tiles, and an object piece for each player to be protected against capture by a playing piece of the other player. Each square area has a recess centrally thereof which is of the same square configuration but having a smaller dimension than the square area. The titles also have the same smaller dimension as the recesses. The square areas are colored differently than the tiles such that when the tiles are placed on the recesses the colors of the square areas can be seen between the tiles accentuating the boundaries of the square areas. The removable tiles are marked to indicate three different kinds of terrain, one kind representing water permitting movement only along either orthogonal axis of the board, the second kind representing mountains permitting movement only diagonally, and the third kind representing land permitting movement along either orthogonal axis or diagonally.

14 Claims, 2 Drawing Sheets

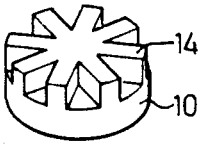
FIG 2
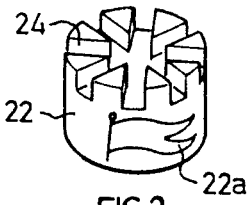
FIG 3
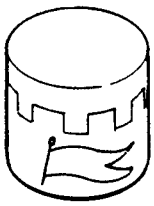
FIG 4
FIG 5
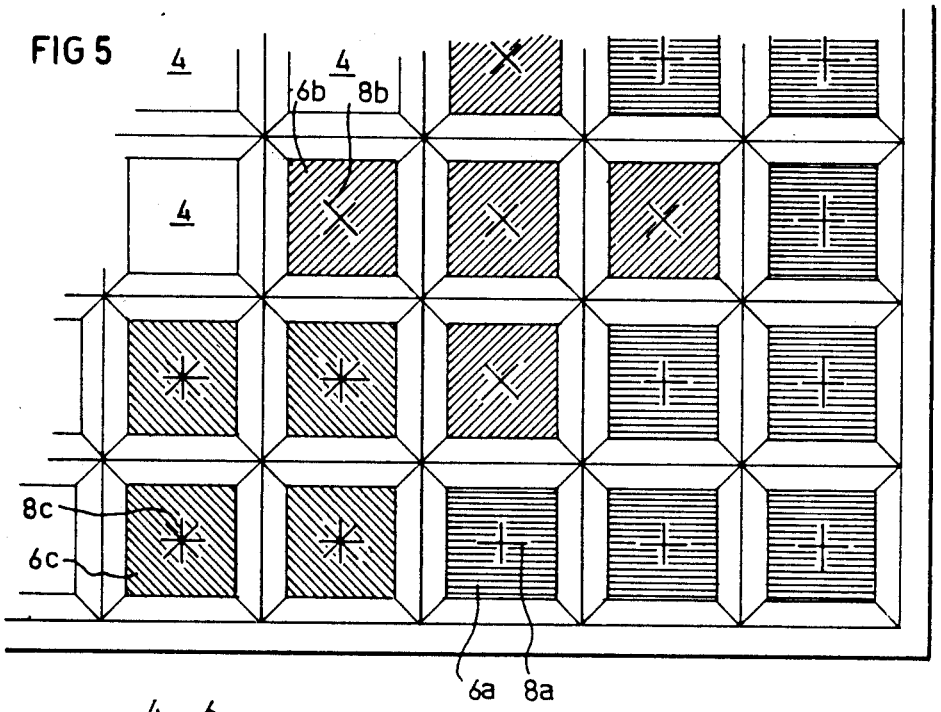
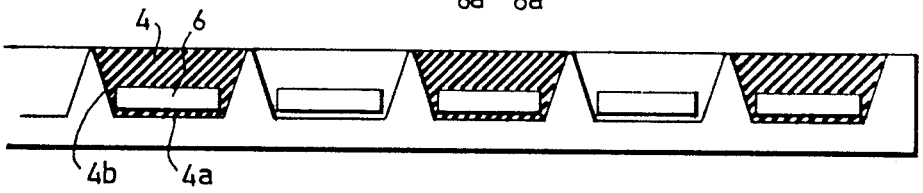
FIG 6
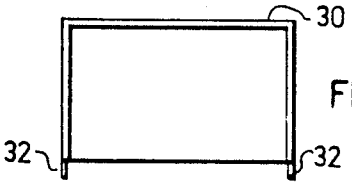
FIG 7

BOARD GAME

BACKGROUND OF THE INVENTION

The present invention relates to a board game playable by at least two players, and particularly to a type of board game which permits the board to be rearranged to create a new board each time it is played. The invention is particularly applicable to a game involving "paladins" and "palatinates", and is therefore described below with respect to this type of game.

During the Middle Ages, Europe was divided into small territories called "palatinates". Palatinates were the property of the palatine, the feudal lord or prince who ruled the territory from his palace or castle. Each prince had a personalized banner which was the ensign of the palatinate. In Italy, this special banner was known as the "Gonfalon". In some of the palatinates there was a special class of knights who were exceptionally skilled, chivalrous, and loyal to their prince. These legendary champions were known as "paladins". They would protect the palatinate from invaders, as well as undertake heroic exploits for the honor of their prince. Occasionally, paladins were chosen to battle in a formal tournament or contest which decided the outcome of the conflict between two palatinates.

The invention of the present application relates to a game which may be used to represent such a tournament or contest.

The invention also relates to a game including a game board using removable tiles. Various games have heretofore been proposed using game boards having removable tiles. Examples of some previously known games of this type are described in Maris U.S. Pat. No. 1,165,688, Olsen U.S. Pat. No. 2,585,268, Foster U.S. Pat. No. 2,732,211, Hardesty et al. U.S. Pat. No. 3,309,092, Laker U.S. Pat. No. 3,799,549 and Powers U.S. Pat. No. 3,820,791.

OBJECTS AND BRIEF SUMMARY OF THE INVENTION

A broad object of the present invention is to provide an novel board game using removable tiles which enable a new board to be created each time the game is to be played. A more particular object of the invention is to provide a board game which may be used to simulate the above-described contest between the paladins of two palatinates.

According to the present invention, there is provided a board game playable by at least two players, comprising: a board divided into a plurality of identical polygonal areas; each formed with a recess of the same configuration as, but of smaller dimensions than, said polygonal areas and centrally thereof a plurality of removable tiles, each of the shape of one of the recess and of sufficient number to fill all the recesses of the board when placed thereon; a plurality of playing pieces for each player movable over the tiles when placed on the board; and an object piece for each player to be placed on the board and to be protected against capture by a playing piece of the other player when moved over the tiles on the board. The plurality of removable tiles are marked to indicate at least two different kinds of terrain, each permitting a different kind of movement of the playing pieces thereover when attempting to capture the object piece of the other player.

In the preferred embodiment of the invention described below, the plurality of removable tiles are marked to indicate at least three different kinds of terrain, one kind representing water permitting movement only along either orthogonal axis of the board, the second kind representing mountains permitting movement only diagonally, and the third kind representing land permitting movement either orthogonally or diagonally.

According to another feature in the described preferred embodiment, the playing pieces and the object pieces include radially extending interengaging ribs and recesses of their outer surfaces enabling an object piece of one player to be attached to and to be moved with a playing piece of the other player when captured thereby.

According to still further features, the plurality of removable tiles are marked with different colours to indicate at least two kinds of terrain each permitting a different kind of movement of the playing pieces thereover when attempting to capture the object piece of the other player; further, the tiles are of smaller dimensions than the polygonal areas, and the polygonal areas are of a further colour viewable between the tiles when placed on the board to accentuate the boundaries of the polygonal areas.

The game is particularly applicable for simulating the contest between warriors or paladins of a particular territory or palatinate, as described above, in which case the column on each side of the board represents the respective "palatinate", the playing pieces represent "paladins", and the object piece represents the flag or "Gonfalon" of a palatinate.

Further features and advantages of the invention will be apparent from the description below.

BRIEF DESCRIPTION OF THE DRAWINGS

The invention is herein described, by way of example only, with reference to the accompanying drawings, wherein:

FIG. 2 is a three-dimensional view illustrating one configuration of the playing pieces that may be used in the board game of FIG. 1;

FIG. 3 illustrates one configuration of the object pieces that may be used in the board game of FIG. 1;

FIG. 4 is a three-dimensional view illustrating the attachment of a playing piece of FIG. 2 to an object piece of FIG. 3 when captured thereby;

FIG. 5 is an enlarged fragmentary view more particularly illustrating the construction of the board of FIG. 1;

FIG. 6 is a sectional view along line VI—VI of FIG. 5; and

FIG. 7 illustrates a divider wall which may be included with the board game to enable each player to set-up the terrain on its side of the board so as to be shielded from view by the other player.

DESCRIPTION OF A PREFERRED EMBODIMENT

Figure 1:
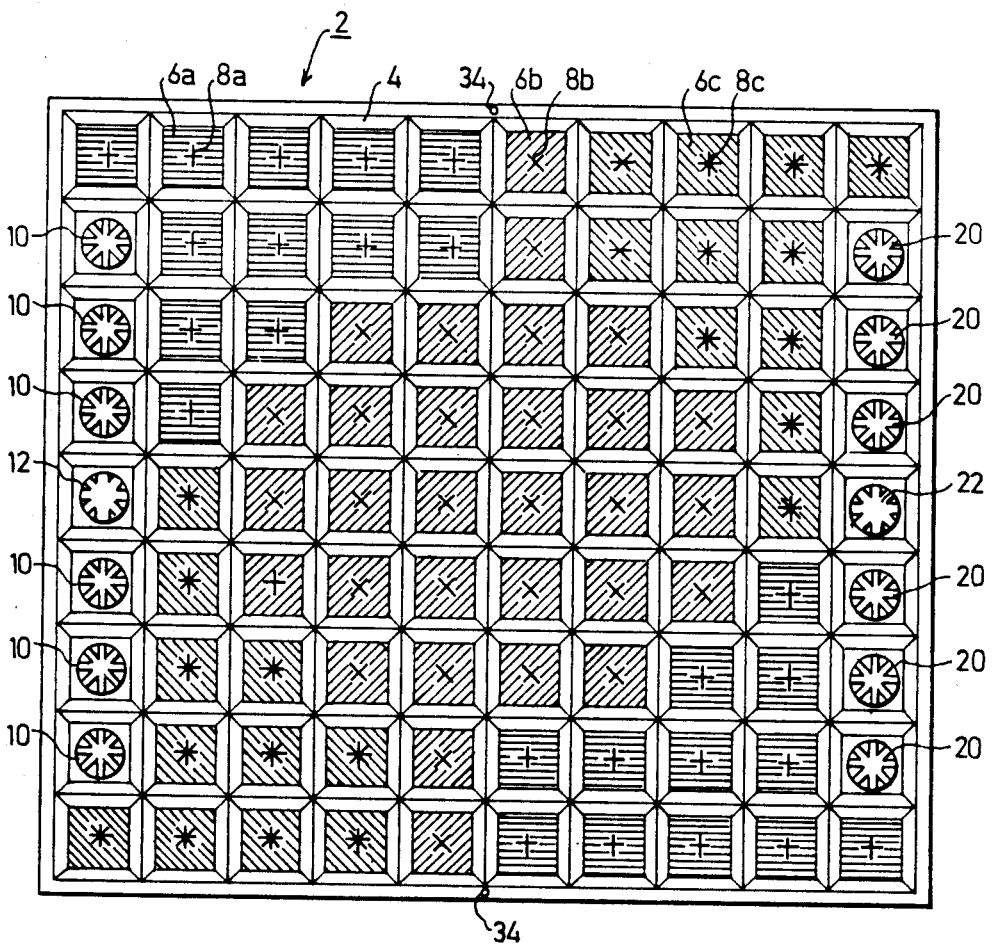
FIG. 1 is a top plan view illustrating one form of board game constructed in accordance with the present invention.

The board game illustrated in the drawings is designed particularly for simulating a formal contest between two paladins or warriors to decide the outcome of a conflict between two palatinates, as briefly described above. The contest is won when the paladin of one palatinate captures an object piece, called the flag or "Gonfalon" of the other palatinate and returns it to the location on the board representing the palatinate of the capturing paladin.

The illustrated game includes a board 2 divided into a plurality of identical polygonal areas. In this case, the board 2 is divided into a plurality of identical squares 4 (FIGS. 5, 6) arranged in a rectangular matrix, consisting of nine horizontal rows of ten squares in each row, or a total of ninety squares. As shown particularly in FIGS. 5 and 6, each of the squares is formed with a recess of the same square configuration as, but of smaller dimensions than, the squares 4 and centrally thereof. Each recess is defined by a flat bottom wall 4*a* bordered by four inclined side walls 4*b*. As also shown in FIGS. 5 and 6, the bottom walls 4*a* and side walls 4*b* of alternate squares are coloured black and white, respectively, so that each white square is bordered on all four sides by a black square, and each black square is bordered on all four sides by a white square.

The game further includes a plurality of removable tiles 6, each of square shape and each of the size of the bottom walls 4*a* of the squares 4. The number of tiles 6 equals the number of squares, i.e., ninety tiles in this case, so that there are a sufficient number of tiles to fill all the squares of the board when placed thereon.

As shown particularly in FIG. 1, the square tiles 6 are marked to indicate three different colours; thus, tiles 6*a* are coloured blue, tiles 6*b* are coloured brown, and tiles 6*c* are coloured green. The three different colours of the tiles indicate three different types of terrain represented by the tiles, which permit different kinds of movement of the playing pieces over the tiles. Thus, the blue tiles 6*a* represent water permitting movement only along either orthogonal axis (i.e., horizontally or vertically in FIG. 1) of the board; the brown tiles 6*b* represent mountains permitting movement only diagonally; and the green tiles 6*c* represent land permitting movement either orthogonally or diagonally. The upper face of each tile is marked with a marking indicating the type of movement permitted by that tile, as shown by markings 8*a*, 8*b* and 8*c* on tiles 6*a*, 6*b* and 6*c*, respectively.

The tiles 6 are of substantially the same configuration and dimensions as the bottom wall 4*a* (FIGS. 5, 6) of the squares 4. Thus, when a tile is placed within its square, it completely covers the bottom wall 4*a* so that the colour of the respective tile is viewable; however, it does not cover the side walls 4*b* of the square, so that the colour of the side walls 4*b* of the squares are viewable between the tiles and thereby accentuates the boundaries of the squares.

The game further includes six playing pieces 10 and a single object piece 12 for one player and therefore of one colour, and six playing pieces 20 and a single object piece 22 for the other player and therefore of another colour. For example, the six playing pieces 10 and the object piece 12 for one player may be coloured white, and the six playing pieces (20) and the object piece 22 of the other player may be coloured black. The six playing pieces 10, 20, for each player represent "warriors", or "paladins" in this case; whereas the single object piece 12, 22 for each player represents the flag or "Gonfalon" to be protected against capture.

Each of the paladin playing pieces 10, 20 can move over one or more squares 4 of the board, but the direction of movement is determined by the terrain over which the paladin is moving, which in turn is determined by the colour of the tile in the respective squares. Thus, when the next tile in the direction of movement of a paladin 10, 20, is blue, the paladin can move only along either orthogonal axis, as indicated by the blue marking 8*a*. The paladin is movable over as many squares as desired by the player and as permitted by the terrain indicated by the tiles. A brown tile 6*b* permits movement of the paladin only in the diagonal direction as indicated by marking 8*b* on tile 6*b*; and a green tile 6*c* permits movement of the paladin along either orthogonal axis or diagonally, as indicated by the marking 8*c* on the brown tiles 6*c*.

The object piece 12, 22 of each player, representing the "Gonfalon" or flag to be defended against capture, is not independently movable, but can be moved only when captured by a paladin of the other player.

FIG. 2 illustrates the construction of each of the paladins 10, 20; and FIG. 3 illustrates the construction of each of the object pieces or "Gonfalons" 12, 22. It will be seen that both are of cylindrical configuration, but the "Gonfalon" (22) is somewhat longer so a to be easily distinguishable from the paladins. The "Gonfalon" (22) may also be marked with a flag, as shown at 22*a*.

While FIG. 2 illustrates the construction of only one paladin 10, it will be appreciated that all the paladins 10 for one player, as well as all the paladins 20 for the other player, are of identical construction, except that the paladins of the two players are differently coloured. Similarly, while FIG. 3 illustrates only the "Gonfalon" 22 of one player, it will be appreciated that the "Gonfalon" 12 of the other player is of identical construction but differently coloured.

As shown in FIGS. 2 and 3, the upper outer faces of all the paladins 10 (and 12), and of both of the "Gonfalons" 22 (and 20) are formed with radially extending interengaging ribs 14 and recesses 24 enabling a "Gonfalon" of one player to be attached to and to be moved with a paladin of the other player when captured thereby, as shown in FIG. 4.

The illustrated game further includes a divider wall as illustrated in FIG. 7, therein designated 30. Divider wall 30 may be placed across the midline of the board line 2 in order to shield one side of the board from view by the player at the opposite side during the initial setting up of the board with the tiles 6. For this purpose, divider wall 30 has a width at least equal to that of the board 2, and a height sufficient to shield one side of the board from view by the player at the opposite side. As one example, divider wall 30 may be nine squares wide and eight squares high, and may be provided with bottom pins 32 at its opposite sides receivable within openings 34 formed at the opposite sides of the board in alignment with its midline.

Following is one example of rules that may be used for playing the game illustrated in the drawings.

First, the board is set-up with the tiles 6 to represent a predetermined terrain. FIG. 1 illustrates one example of such a terrain that may be set-up. Beginning players may mutually agree beforehand on the terrain to be set-up, by the tiles 6. However, advanced players may use the divider wall 30 for shielding one side of the board from the player at the opposite side so that each player can set-up the terrain on his side of the board according to a predetermined strategy, without the other player being aware of the set-up. When both players have completed placing all the tiles 6 on their respective sides of the board, the divider wall 30 is moved.

It will be seen that when all the tiles 6 are placed in the squares 4, the colour of each tile will be viewable, but also viewable will be the side walls 4b of each square. Since these side walls are alternately coloured (e.g., black and white), each of the tiles 6 will be bordered by a black or white border. This arrangement accentuates the boundaries of the squares and is particularly helpful since it makes the diagonal lines of movement across the tiles more discernible.

The two players, sitting at opposite sides of the board, then place their respective "Gonfalons" 12, 22 on the center square in the first row of nine squares nearest him; this entire row is called that player's "palatinate". Each player then places his paladins 10, 20 on the remaining squares of his palatinate, leaving the two corner squares unoccupied.

The players now alternate turns. In each turn, the player may move one paladin at least one square, or as many squares as desired in one straight line in any one direction, provided the direction of movement is permitted by the terrain. Thus, if the next square in the direction of movement of a paladin is occupied by a blue tile 6a, the paladin may move across that tile only along one of the two orthogonal axes; if the next square is occupied by a brown tile 6b, the paladin may move diagonally; but if the next square is occupied by a green tile 6c, the paladin may move either orthogonally or diagonally. A paladin may thus move across a different terrain in a single move as long as no change in direction is required and the terrain permits that particular movement. However, a paladin may not move across or skip a square which is occupied by any other paladin.

Each paladin may capture a paladin of the other player by landing on the same square occupied by the paladin of the other player. The captured paladin is removed from the board for the duration of the game. Making a move to capture a paladin is optional, but may take place only at the end of a move. Thus, a paladin could move not only to capture another paladin or the "Gonfalon", but could also move to a "threatening" position, wherein it could capture the paladin or "Gonfalon" in the next move.

To capture an opponent's "Gonfalon", or to rescue his own "Gonfalon", one of the paladins must land on the square occupied by that "Gonfalon", whereupon the paladin is inverted and its ribs 14 are applied to the recesses 24 of the captured (or rescued) "Gonfalon", as shown in FIG. 4. Thereafter, the captured (or rescued) "Gonfalon" and the capturing (or rescuing) paladin are moved as a unit. Whenever a "Gonfalon" is captured, the capturing paladin is entitled to another move, whereupon the captured "Gonfalon" is moved with the paladin.

The game is won by the player who succeeds in capturing the "Gonfalon" of the other player and returning it to his palatinate, while at the same time retaining possession of his "Gonfalon" in his palatinate.

While the invention has been described with respect to one preferred embodiment, it will be appreciated that many variations, modifications and other applications of the invention may be made.

I claim:

1. A board game playable by at least two players, comprising:

a board divided into a plurality of identical polygonal areas each formed with a recess of the same configuration as, but of smaller dimensions than, said polygonal areas and centrally thereof;

a plurality of removable tiles, each of the shape of one of said recesses and of sufficient number to fill the recesses of all said areas of the board when placed thereon;

a plurality of playing pieces for each player movable over the tiles when placed on the board;

and an object piece for each player to be placed on the board and to be protected against capture by a playing piece of the other player when moved over the tiles on the board;

said plurality of removable tiles being marked to indicate at least two different kinds of terrain each permitting a different kind of movement of the playing pieces thereover when attempting to capture the object piece of the other player.

2. The board game according to claim 1, wherein said plurality of removable tiles are marked to indicate at least three different kinds of terrain, one kind representing water permitting movement only along either orthogonal axis of the board, the second kind representing mountains permitting movement only diagonally, and the third kind representing land permitting movement along either orthogonal axis or diagonally.

3. The board game according to claim 1, wherein said playing pieces and said object pieces include radially-extending, interengaging ribs and recesses on their outer surfaces enabling an object piece of one player to be attached to, and to be moved with, a playing piece of the other player when captured thereby.

4. The board game according to claim 1, wherein said board is of rectangular configuration and is divided into a rectangular matrix of equal squares.

5. The board game according to claim 1, further including a divider wall of a width at least equal to that of the board and of a height sufficient to shield the side of the board to be occupied by one player's playing pieces and object piece, from view by the other player whose playing pieces are to occupy the opposite side of the board.

6. A board game playable by at least two players, comprising:

a board divided into a plurality of identical polygonal areas;

a plurality of removable tiles, each of the shape of one of said areas and of sufficient number to fill also said areas of the board when placed thereon;

a plurality of playing pieces for each player movable over the tiles when placed on the board;

and an object piece for each player to be placed on the board and to be protected against capture by a playing piece of the other player when moved over the tiles on the board;

said plurality of removable tiles being marked to indicate at least two different kinds of terrain each permitting a different kind of movement of the playing pieces thereover when attempting to capture the object piece of the other player;

said tiles being of smaller dimensions than said polygonal areas, and said polygonal areas being of a further colour viewable between said tiles when placed on the board to accentuate the boundaries of said polygonal areas.

7. The board game according to claim 6, wherein each of said recesses is circumscribed by inclined walls defining said lines of said further colour viewable between the tiles when placed on the board.

8. The board game according to claim 7, wherein alternate ones of said inclined walls are of said further colour.

9. A board game playable by two players, comprising:

a rectangular board divided into a rectangular matrix of equal squares each formed with a recess of the same square configuration as, but of smaller dimensions than, said squares and centrally thereof;

a plurality of removable square tiles of the same dimensions as, and of sufficient number to fill all, said square recesses of the board when placed thereon;

a plurality of playing pieces, each representing a warrior, for each player movable over the tiles when placed on the board;

and an object piece, representing a flag, for each player to be placed on the board and to be protected against capture by a warrior piece of the other player when moving over the tiles on the board;

said plurality of removable tiles being marked to indicate at least two different kinds of terrain each permitting a different kind of movement of the warrior pieces of one player thereover when attempting to capture the flat piece of the other player;

said tiles being of smaller dimensions than said squares, and said squares being of a colour viewable between said tiles when placed on the board to accentuate the boundaries of said squares when covered by said tiles.

10. The game according to claim 9, wherein said warrior pieces and flag pieces are formed with interengageable ribs and recesses enabling a flag piece of one player to be attached to and to be moved with a warrior piece of the other player when captured thereby.

11. The board game according to claim 9, wherein said plurality of removable tiles are marked to indicate at least three different kinds of terrain, one kind representing water permitting movement only along either orthogonal axis of the board, the second kind representing mountains permitting movement only diagonally, and the third kind representing land permitting movement along either orthogonal axis or diagonally.

12. The board game according to claim 9, wherein said plurality of removable tiles are marked with different colours to indicate at least three different kinds of terrain each permitting a different kind of movement of the warrior playing pieces of one player thereover when attempting to capture the object flag piece of the other party.

13. The board game according to claim 9, wherein each of said recesses is circumscribed by inclined walls viewable between said tiles when placed on the board.

14. The board game according to claim 9, further including a divider wall of a width at least equal to that of the board and of a height sufficient to shield the side of the board to be occupied by one player's playing pieces and object piece from view by the other player when playing pieces are to occupy the opposite side of the board.

* * * * *